United States Patent [19]

Lavergne

[11] Patent Number: 4,654,992

[45] Date of Patent: Apr. 7, 1987

[54] FIRE-ARM SAFETY DEVICE

[76] Inventor: Robert Lavergne, P.O. Box 351, Cheneville, Quebec, Canada, J0V 1E0

[21] Appl. No.: 779,098

[22] Filed: Sep. 23, 1985

[51] Int. Cl.[4] ..... F41C 11/02; F41C 11/06; F41C 17/08

[52] U.S. Cl. ..... 42/70.01; 42/70.11

[58] Field of Search ..... 42/1 LP, 70 R, 70 D, 42/70.01, 70.11, 96, 106; 124/40

[56] References Cited

U.S. PATENT DOCUMENTS

| | | | |
|---|---|---|---|
| 1,842,847 | 1/1932 | Stange | 42/70 R |
| 3,018,576 | 1/1962 | Riechers | 42/70 R |
| 3,765,115 | 10/1973 | Johansson et al. | 42/1 LP |
| 3,774,333 | 11/1973 | Reynolds | 42/1 LP |
| 4,058,923 | 11/1977 | Smith | 42/1 LP |
| 4,122,620 | 10/1978 | Alexander | 42/1 LP |
| 4,412,397 | 11/1983 | Bayn | 42/1 LP |

OTHER PUBLICATIONS

Webster, Webster's Ninth New Collegiate Dictionary, 1985, p. 992.

*Primary Examiner*—Stephen C. Bentley
*Assistant Examiner*—Stephen Johnson

[57] ABSTRACT

There is disclosed a safety device for preventing unauthorized use of an automatic or semi-automatic hand-held fire-arm, such as a shotgun, rifle or revolver, and of the type in which the loading chamber is provided with a lateral opening. The safety device comprises a metallic U-shape frame adapted to surround the underside and lateral sides of the loading chamber. A key-operated lock causes a frame-carried stop member to enter the loading chamber through the lateral opening to secure the device to the gun and to block access to both the magazine and the breech or firing chamber of the fire-arm to prevent magazine loading and passage of bullets or cartridges from the magazine to the breech. The frame also prevents operation of the loading mechanism.

4 Claims, 9 Drawing Figures

FIRE-ARM SAFETY DEVICE

FIELD OF THE INVENTION

This invention relates to safety devices for preventing unauthorized use of a hand-held automatic or semi-automatic fire-arm of the type in which the loading chamber has a lateral access opening.

BACKGROUND OF THE INVENTION

Several accidents involving fire-arms are reported as occurring daily, either with small playful children, depressive individuals, or psychopaths.

Safety devices have been proposed in the art to prevent introduction of a cartridge or bullet into the firing chamber of the gun; for example, Canadian patent No. 934,198, issued Sept. 25, 1975 to Lennart Johansson, Sven Andersson, and Jan Eliasson. In this patent, the safety device 17–18 is designed to lock the gun against use thereof, by engagement of the metal body 17 of the device into the conventional counterbore 13 of the fire-arm. This device is not designed for use with an automatic of semi-automatic rifle or gun.

Moreover, as clearly stated at page 1, lines 7–11 of Johansson et al, the safety device is in such engagement with the vital parts of thereby-locked fire-arm that a forcible removal of the safety device, such as by breaking it open or tearing it off, would damage the fire-arm in such a manner that the fire-arm cannot be used thereafter.

Fire-arms are precisely-machined pieces of equipment and damages incurred by same generally means a high repair cost. It is believed that the damaging of the fire-arm is not in itself the main deterrent to its unauthorized use, although, of course, it will prevent that use. It is rather believed that, for the great majority of cases, when unauthorized use of a fire-arm is envisioned by an individual, a simple but efficient locking device that will, prevent engagement of a cartridge or bullet into the firing chamber without damage being done to the vital parts of the gun upon forcible disengagement thereof, will be just as good a deterrent, provided the level of skill and time required to render inoperative the safety locking device is high.

Unauthorized activities involving the use of fire-arms are normally the result of a psychological propess (either playfulness or anger) that follows a temporary or cyclical pattern, whereby these individuals would be discouraged to attempt to use the gun. It is thus believed that destruction of the gun is not a prerequisite.

OBJECT OF THE INVENTION

The gist of the present invention is therefore, accordingly with the problems stated in the background of the invention, to provide a type of simple and efficient safety locking device for the breech of a fire-arm that will lock both the barrel and the magazine and that will not damage the vital parts thereof upon the rendering inoperative of the device after a large expenditure of skill and time.

SUMMARY OF THE INVENTION

Accordingly with the object of the invention, there is disclosed a safety device for preventing unauthorized use of a hand-held, automatic or semi-automatic fire-arm of the type in which the loading chamber has a lateral access opening, such as a revolver, shotgun or rifle. The safety device comprises a U-shape frame, adapted to surround the underside and lateral sides of the gun-loading chamber. A key-operated lock causes a stop member carried by the frame to enter the loading chamber through the lateral access opening to secure the device to the fire-arm and to block ammunition passage from the magazine to the breech or firing chamber of the fire-arm, albeit spacedly from the breech. The device also prevents operation of the breech block. When the fire-arm has an underside magazine loading aperture, the U-shape frame has a lateral leg to close the same and also to engage and retain the breech block in actuating lever, the U-shape frame prevents its operation.

DETAILED DESCRIPTION OF THE EMBODIMENTS OF THE INVENTION

Figure 6:
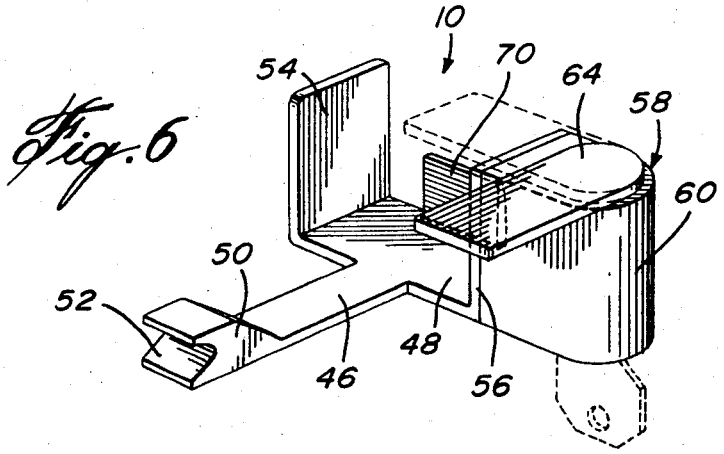
FIG. 6 is a perspective view of the first embodiment of the safety device, suitable for the shotgun of FIG. 1.

The first embodiment of the safety device is shown in FIG. 6 and bears reference numeral 10. This safety device 10 is for use with a shotgun, such as the pump-action shotgun 12 shown in FIGS. 1 to and 5.

Shotgun 12 conventionally comprises front metallic barrel 14, magazine 16 (surrounded by a wooden, pump action member 18), rear wooden butt 20 and an intermediate metallic casing 22 including a loading chamber 24 and a breech block 26 actuated by trigger member 28 and carrying a firing pin 38 and extractor claws 40. Gun barrel 14 is connected to casing 22 by collar 30. Trigger guard 32 surrounds trigger 28. Safety device 10 is to be secured around the sides of loading chamber 24.

This chamber has the usual lateral aperture 74 for ejection of the spent shell and manual loading one cartridge 34 into the breech barrel 14. Loading chamber 24 has also a bottom aperture 36 for loading magazine 16 with several cartridges such as cartridge 34A.

The top of casing 22 carries the known safety catch 42, slidable within slot 44 and which inhibits triggering of needle 38.

Safety device 10 has a central flat body, of generally T-shape, defining a main narrow leg 46 and a head 48. The end of leg 46 comprises a thickened portion 50 which is grooved at 52 transversely to the length of the leg and parallel to the plane thereof. From the ends of head 48 upwardly project similar flanges 54, 56, spaced by a distance slightly greater than the width of the casing 22.

On the outer face of the flange 56, there is fixedly secured a lock member 58. lock member consists of a sturdy metal housing 60 surrounding a rotatable cylindrical locking barrel 62 which is parallel to the casing lateral sides when the device 10 is secured to the casing 22.

To the top end of barrel 62 is fixedly secured a transversely-projecting finger plate 64 (or other such stop member) and the bottom end thereof is slotted at 66 for operative engagement by a key 68. An upturned blocking lug or flange 70 (smaller than flanges 54, 56) also projects from the outer edge of head 48, registering with the longitudinal axis of leg 46.

Figure 4:
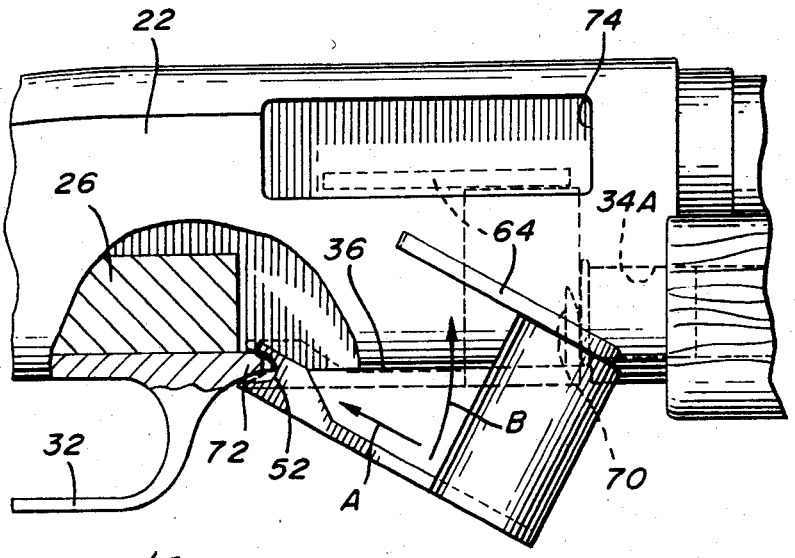
FIG. 4 is an enlarged side elevation of the shotgun-loading chamber of FIG. 1, partially in section and showing the safety device being positioned.

Safety device 10 is operatively secured to the shotgun 12 by first engaging leg groove 52 around a seating flange 72 frontwardly of the base of trigger guard 32, following arrow A in FIG. 4, and then pivoted upwardly into casing aperture 36, following arrow B. Therefore, flange 72 is used as a seat for guiding pivoting of the locking device to and from operative position.

Figure 3:
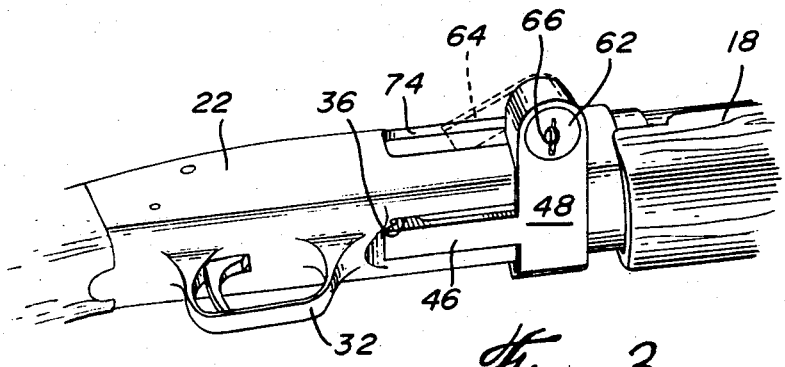
FIG. 3 is an upwardly-forwardly looking perspective view of the bottom of the shotgun shown in FIG. 1.

As best seen in FIG. 3, in operative position, the safety device head 48 abuts on the frontmost underside of chamber 24 transversely thereof, with leg 46 extending toward trigger 28, wherein the finger plate 64 with the conventional rectangular ejector slot 74 of the chamber.

Figure 1:
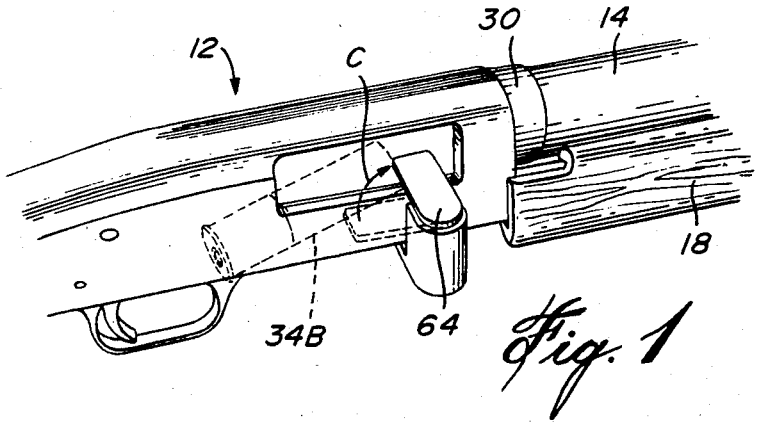
FIG. 1 is a downwardly-forwardly looking perspective view of the side of a broken part of a pump-action shotgun, showing the safety device of the invention secured thereto, with a cartridge illustrated in phantom lines.
Figure 2:
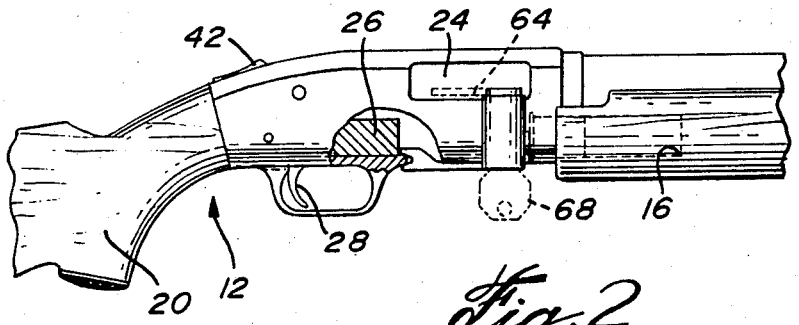
FIG. 2 is partly sectional side elevation of the shotgun of FIG. 1.

Blocking flange 70 enters through bottom aperture 36 and closes the passage between the magazine 16 and the chamber 24 when the locking device is operative as shown in FIGS. 1 to 3), to prevent unauthorized feeding of a cartridge 34A (see FIG. 4) into the loading chamber.

Figure 5:
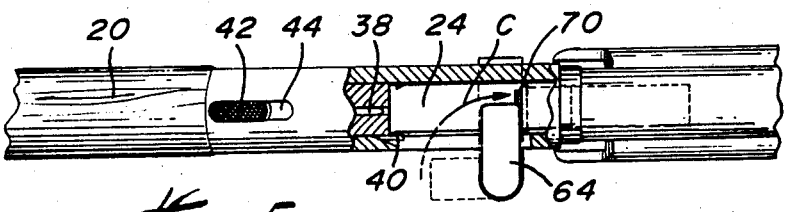
FIG. 5 is a partly sectional top plan view of the shotgun of FIG. 1, the safety device shown in operative position.

Actuation of the key 68 will rotate lock barrel 62 and, thus, finger plate 64 will pivot along direction C of FIG. 1 or 5 through ejector slot 74, into chamber 24, to fully prevent positioning of a cartridge 34B into firing position in the loading chamber and in the gun barrel 14.

Thickened portion 50 abuts retracted breech block 26 (FIG. 2) and prevents its actuation.

Removal of the key 68 and storage thereof in a hidden location prevents unauthorized unlocking of the safety device.

It is recognized that this safety device may eventually be rendered ineffective with appropriate tools. However, this will take time and skill, which considerations are prone to deter or discourage such an endeavour. This is especially the case with playful small children, or alternately, with depressive individuals having temporary or cyclical suicidal tendencies. In the province of Quebec, for example, according to the official records of compiled voluntary deaths, suicide has increased by more than four times in between 1950 and 1981; and, furthermore, 40% of the young men aged 15 to 30 who die from suicide have used a fire-arm for that purpose. Hence, the necessity of such a safety device.

Figure 7:
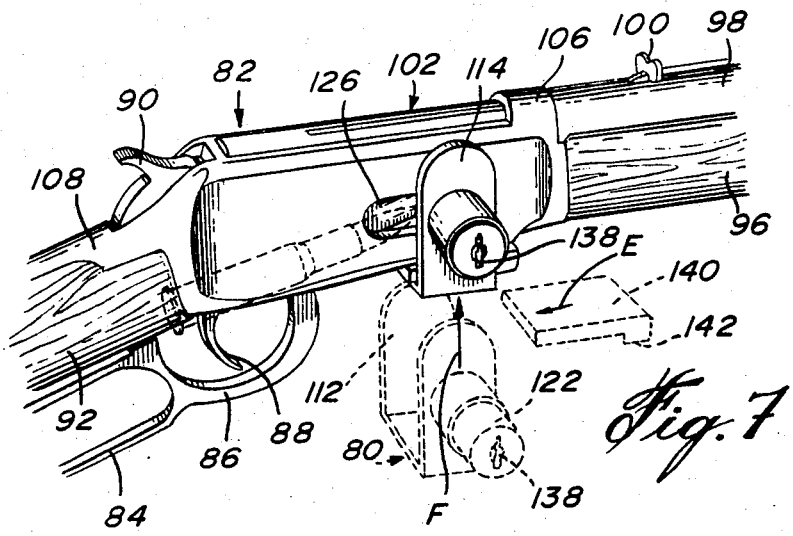
FIG. 7 is a downwardly-forwardly looking perspective view of the side of a lever-operated rifle, provided with the second embodiment of the safety device, which is shown operatively engaged into the rifle chamber in full lines and disengaged therefrom in phantom lines, and also showing a long-range bullet in dotted lines.
Figure 8:
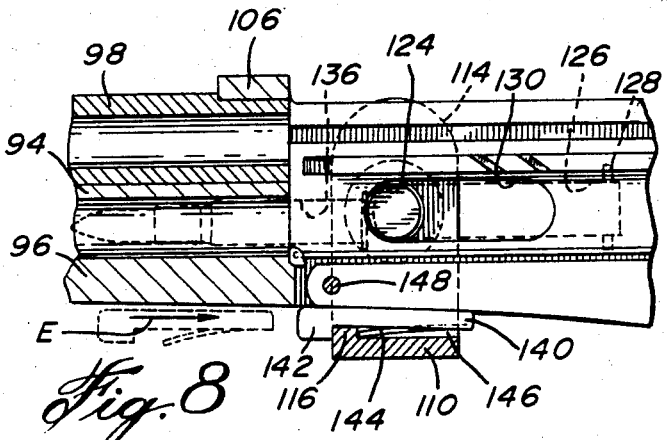
FIG. 8 is an enlarged longitudinal vertical sectional view of the rifle and of the second embodiment of the safety device in operative position, said view being inverted relative to the perspective view shown in FIG. 7.
Figure 9:
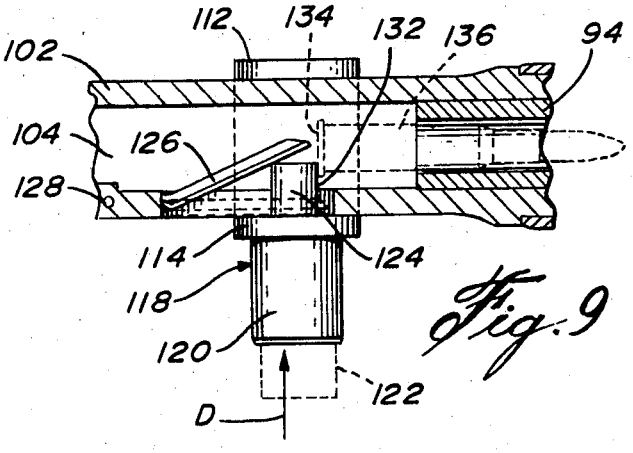
FIG. 9 is an enlarged longitudinal horizontal sectional view of the rifle shown in FIG. 7, taken above the second embodiment of the safety device.

The second embodiment of the invention is illustrated in FIGS. 7 to 9 and is denoted 80. Safety device 80 is adapted to prevent unauthorized use of a rifle, such as the repeating rifle 82.

Rifle 82 conventionally includes a repeat crank lever 84, with integral trigger guard 86 surrounding trigger 88; an outer pivoted firing lever 90; wooden rear butt 92 and front magazine 94 (surrounded by a fixed wooden shield 96); front barrel 98, with associated aim 100; and intermediate casing 102 comprising the bullet-triggering mechanism and the loading chamber 104 and defining a front arcuate lug 106, to retain barrel 98 to casing 102, and a rear arm 108, to retain butt 92 to casing 102.

Safety device 80 comprises a base plate 110 from which extend two opposite upright flanges 112, 114 spaced by a distance slightly greater than the width of casing 102 and an intermediate upturned shoulder 116, of much smaller height than flanges 112, 114. A lock member 118 is fixedly secured to the outer face of flange 114.

Lock member 118 consists of a sturdy housing 120 and a cylindrical barrel 122 axially slidable in housing 120, normal to the casing lateral sides when the frame is secured to the casing, and projecting outwardly from housing 120 in inoperative position and carrying an axial plunger 124 which projects inwardly of housing 120 and through flange 114 in operative position. Plunger 124 will open the flap door 126 that is conventionally rearwardly pivoted at 128 to close the lateral ejector slot 130. The side 132 of the extended plunger 124 is in the path of and may abut the rear end 134 of a bullet 136 which one attempts to retrieve from magazine 94, thus preventing passage of the bullet from magazine 94 (see FIGS. 8 and 9) to loading chamber 104.

When barrel 122 is pushed in (arrow D in FIG. 9), it automatically locks in operative position. Barrel 122 is unlocked by a key (not shown) engaging slot 138 at the end face of the barrel, wherein the barrel, once unlocked, springs back to its inoperative position.

Safety device 80 also comprises a wedging member 140 having a small downturned shoulder 142 at one end and a pawl 144 outwardly directed toward shoulder 142 at the other end. Member 140 engages the underside of casing 102, in between the same and base 110, following arrow E of FIG. 7 or 8. The breech block being retracted, the cross-sectionally U-shape device 110–114 is engaged at the bottom of casing 102, with the two flanges 112, 114, being on each side therefor, following arrow F of FIG. 7.

Resilient pawl 144 is retained in inclined slit 146, made in member 140, and prevents disengagement of interlocking shoulders 116, 142. Member 140 prevents loose play of device 80 about casing 102. Device 80, when locked in operative position, also prevents actuation of crank lever 84, which is pivoted to the rifle body at 148.

Plunger 124 prevents introduction of a bullet into the loading chamber and magazine through side ejector slot 130 and prevents passage of such a bullet from the magazine to the barrel 98.

What I claim is:

1. A safety device for preventing unauthorized use of a shotgun including a loading chamber provided with both a lateral ejector opening and an underside loading aperture, a barrel, a magazine and a breech block; said safety device including: a rigid frame removably mounting said shotgun in registry with said lateral ejector opening and said underside loading aperture; first closure means upstanding through said underside loading aperture for closing the inner opening of the magazine of said shotgun upon said rigid frame engaging an operative mounting position; and second movable closure means removably extending through said lateral ejector opening, for releasably closing the inner opening of the barrel of said shotgun, and concurrently locking said safety device to said shotgun in the operative mounting position of the rigid frame; said second movable closure means being movable relative to said frame between operative and inoperative positions and includes a locking menber for actuating said second movable closure means in between its operative and inoperative positions and for concurrently locking said second movable closure means in its operative position against unauthorized disengagement thereof.

2. The safety device defined in claim 1, with said breech block movable in between operative and inoperative positions within said loading chamber, said safety device further including stop means, to lock said breech block in its inoperative position when said rigid frame is in its operative mounting position.

3. A safety device for preventing unauthorized use of a shotgun of the type and in which the loading chamber is provided with a lateral opening and an underside loading aperture and including a barrel, a magazine and a breech block; said safety device comprising a cross-sectionally U-shape frame defining a base portion, two spaced flanges substantially normal to said base portion, a lateral leg to close the underside loading aperture and to prevent access to the magazine, and a stop lug secured to and extending from said base portion between said spaced flanges, said stop lug projecting through said underside loading aperture and in register with the longitudinal axis of the magazine when the frame is secured to said loading chamber; said cross-sectionally U-shape frame surrounding the underside and lateral sizes of the loading chamber, respectively, a stop member movably carried by one of said flanges and movable between an inoperative position clearing the space between said flanges, and an operative position protruding into said space to enter the loading chamber through the lateral opening to secure the device to the shotgun and to block access to the magazine and to prevent actuation of the breeck block; and locking means to lock said stop member in operative position, said locking means comprising an elongated housing secured to said one flange longitudinally thereof, and a key-operated lock barrel rotatable within said elongated housing, said stop member fixedly secured to one end of said key-operated lock barrel.

4. The safety device as defined in claim 9, wherein said lateral leg has a thickened outer leg end, the latter formed with a groove along an axis parallel to the plane of said base portion; said groove receiving an end edge of said underside loading aperture in said operative position, with said thickened outer leg end in the path of the breeck block.

* * * * *